United States Patent [19]

Smith

[11] 4,344,264

[45] Aug. 17, 1982

[54] FLEXIBLE CORNER SEAL STRUCTURE FOR CRYOGENIC CONTAINER

[75] Inventor: Dale A. Smith, Newport Beach, Calif.

[73] Assignee: McDonnell Douglas Corporation, Long Beach, Calif.

[21] Appl. No.: 157,789

[22] Filed: Jun. 9, 1980

[51] Int. Cl.[3] ..... E04B 1/32

[52] U.S. Cl. ..... 52/247; 52/249; 52/573; 220/435; 220/901

[58] Field of Search ..... 52/245, 247, 249, 573; 220/901, 435, 436

[56] References Cited

U.S. PATENT DOCUMENTS

| | | | |
|---|---|---|---|
| 3,047,184 | 7/1962 | Van Bergen et al. | 52/249 X |
| 3,505,769 | 4/1970 | Miron et al. | 52/249 |
| 4,068,777 | 1/1978 | Humphrey et al. | 220/5 A X |
| 4,070,836 | 1/1978 | James et al. | 52/245 |
| 4,117,947 | 10/1978 | Androulakis | 52/249 X |
| 4,136,493 | 1/1979 | Bradford et al. | 52/249 X |

*Primary Examiner*—Carl D. Friedman
*Attorney, Agent, or Firm*—Max Geldin

[57] ABSTRACT

Cryogenic insulation seal for a concrete container, having an inner cryogenic liquid tank, comprising a concrete floor slab, a vertical concrete wall moveably supported on the concrete floor, and insulation positioned within the container adjacent the horizontal floor slab and the vertical concrete wall, and including a metal, e.g. steel, liner positioned around the inner surface of the container, adjacent the inner surfaces of the floor slab and the concrete wall and supporting the insulation, and forming an inner seal around the container. The steel liner is inclined from the vertical at a corner above the floor slab and is attached to the vertical concrete wall at a predetermined height above the floor slab, forming a gap between the liner and the concrete vertical wall at the corner, and permitting inward lateral motion of said vertical wall with respect to the floor slab at such corner, while permitting the steel liner and the insulation supported by the liner to flex and maintain a seal at the corner.

15 Claims, 5 Drawing Figures

FLEXIBLE CORNER SEAL STRUCTURE FOR CRYOGENIC CONTAINER

BACKGROUND OF THE INVENTION

This invention relates to containers, tanks, and the like for storage of cryogenic liquids such as liquid natural gas (LNG), and is particularly concerned with containers and tanks of the above type formed of a concrete floor and unattached concrete wall, with foam or other insulation positioned around the inner surface of the container, including a corner structure which seals the container against liquid but allows for relative motion between the concrete wall and floor at the tank corner.

Many nations are now planning liquefied natural gas (LNG) energy importation projects. These projects require terminals which incorporate large cryogenic receiving tanks. Recent developments, including safety analyses for these tanks, have led designers to a double-tank arrangement where the outer tank will safely contain LNG in the event of an inner tank failure. This outer tank requires insulation between the inner and outer tanks, to protect the structure from thermal gradients and to minimize large quantities of gas that would evolve if the cold liquid were to contact the relatively warm outer tank wall.

Typically, the proposed outer tank design consists of a concrete floor slab with an unattached concrete wall. This wall will move radially relative to the floor for a variety of reasons, including dimensional changes due to concrete curing, external wall loads if an earthen berm is used, material shrinkage due to temperature effects of service and failure conditions, and hydrostatic loads due to liquid in the failed inner tank condition. Thus, an insulation system design is required which must seal against liquid and yet allow for relative motion between the outer tank wall and floor.

Applicant is not presently aware of any prior art insulation/seal design for a moveable concrete corner. Typically, this problem has been avoided by fixing the concrete wall to the floor. While simplifying the insulation and seal design, this fixity greatly magnifies the corner structural stresses, and results in a substantial increase in tank design complexity and cost.

An object of the present invention accordingly is the provision of a relatively simple outer tank corner structure, particularly for a cryogenic container formed of an outer concrete wall and concrete floor, and which provides structural thermal protection in the event of an inner tank failure. Another object is to provide a corner seal structure adjacent the inner surfaces of the concrete tank, which permits limited lateral movement of the bottom portion of the concrete wall with respect to the floor, under service conditions, without undue stresses.

SUMMARY OF THE INVENTION

The above objects are achieved according to the invention, with respect to an outer concrete tank containing an inner cryogenic liquid tank, by the attachment of cryogenic, e.g. foam, insulation to a metal, e.g. steel, liner, which is attached to the concrete wall of the outer tank at the corner thereof in such a manner that the wall is free to move laterally while the liner and attached insulation flex to maintain the seal at the corner.

Thus, according to the invention, there is provided a cryogenic insulation seal for a concrete container, having an inner cryogenic liquid tank, comprising a concrete floor slab, a vertical concrete wall moveably supported on the concrete floor, insulation positioned within the container adjacent the horizontal floor slab and the vertical concrete wall, and including a metal, e.g. steel, liner positioned around the inner surface of the container adjacent the inner surfaces of the floor slab and the concrete wall and supporting the insulation, and forming an inner seal around the container. The steel liner is inclined from the vertical at a corner above the floor slab and is attached to the vertical concrete wall at a predetermined height above the floor slab, forming a gap between the liner and the concrete vertical wall at the corner, and permitting inward lateral motion of said vertical wall with respect to the floor slab at such corner, while permitting the steel liner and the insulation supported by the liner to flex and maintain a seal at the corner.

BRIEF DESCRIPTION OF THE DRAWING

The invention will be more fully understood by the description below of a preferred embodiment taken in connection with the accompanying drawing wherein.

DESCRIPTION OF PREFERRED EMBODIMENTS

Figure 1:
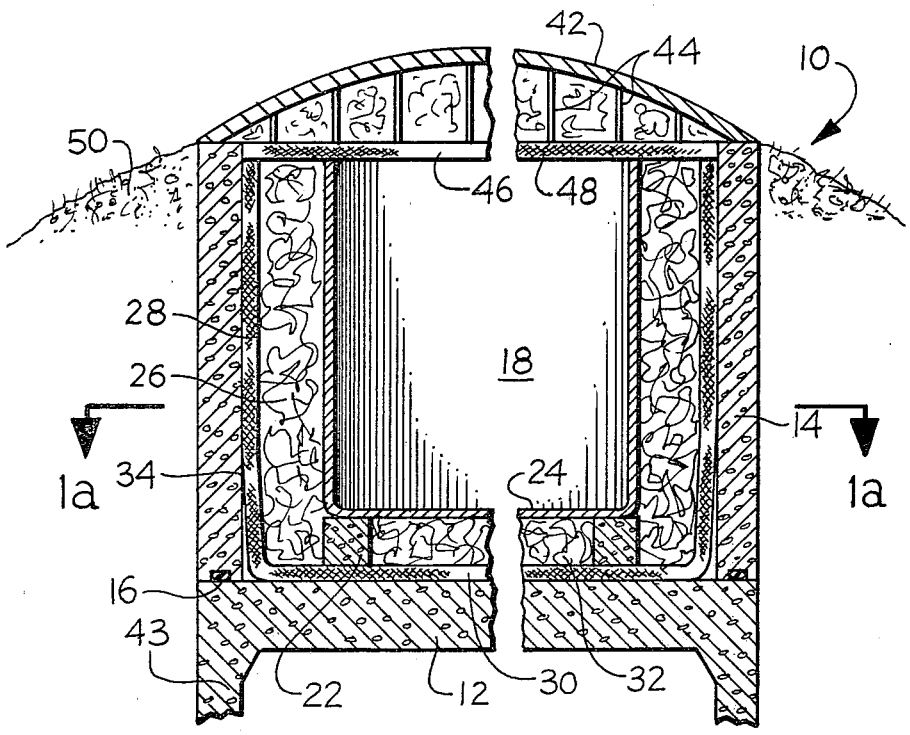
FIG. 1 is a sectional elevational view of a container or tank incorporating the flexible corner seal structure of the invention.
Figure 1A:
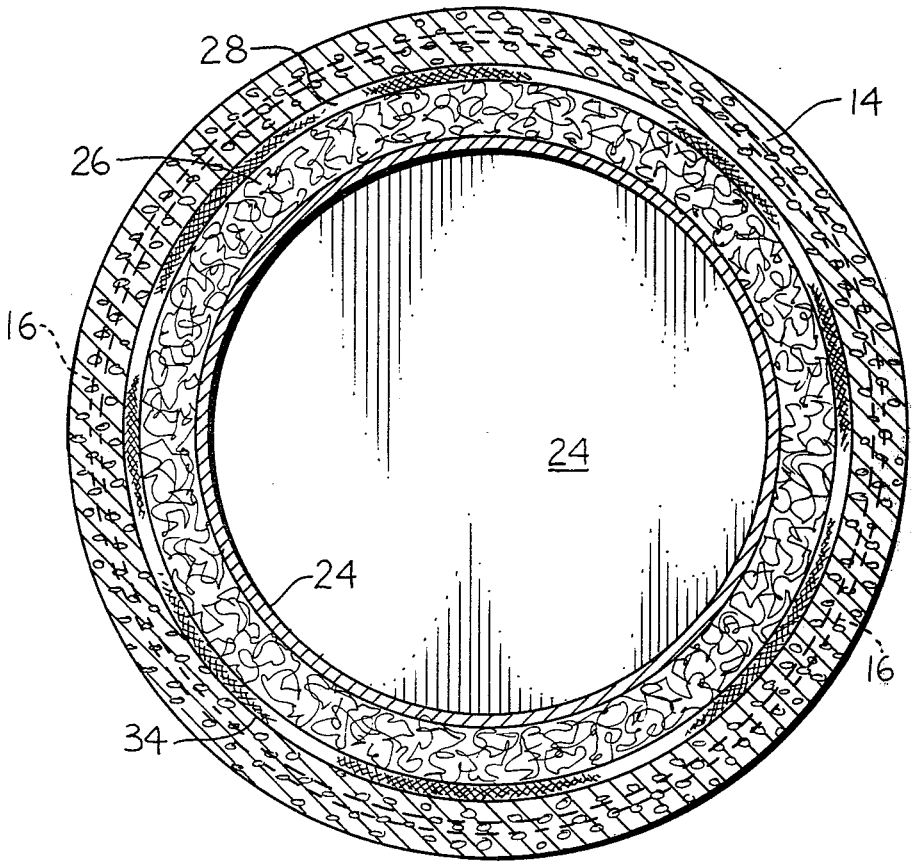
FIG. 1*a* is a horizontal section taken on line 1*a*—1*a* of FIG. 1.

Referring to FIGS. 1 and 1*a* of the drawing, numeral 10 represents a container or tank of generally cylindrical shape, comprised of a concrete horizontal floor slab 12 and a cylindrical concrete wall 14 moveably supported on the surface of the concrete floor slab 12 and sealed by means of a circular resilient seal 16. Thus, the concrete shoulders 17 at the bottom of the wall 14 can be supported on the floor slab, and can slide freely radially thereon as result of system loads. The seal 16 can be formed of any material which will permit relative movement of the vertical concrete wall 14 with respect to the floor slab 12. Thus, the seal 16 can be formed, for example, of polymeric materials or other organic material such as bitumen, which permit relative lateral motion of the vertical wall 14 with respect to the concrete floor slab 12. The tank or container 10 has mounted within the concrete wall 14 thereof a cylindrical tank 18 for storing cryogenic liquids such as LNG. The inner tank 18 of generally cylindrical shape is supported on a tank support member 22, e.g. formed from perlite concrete, which acts as a seal and allows relative motion of tank 18.

The tank 18 has a liner or membrane 24 formed of a low temperature resistant material such as nickel steel, preferably a high nickel steel such as the material marketed as Invar, although other material such as stainless steel can be employed.

Figure 1B:
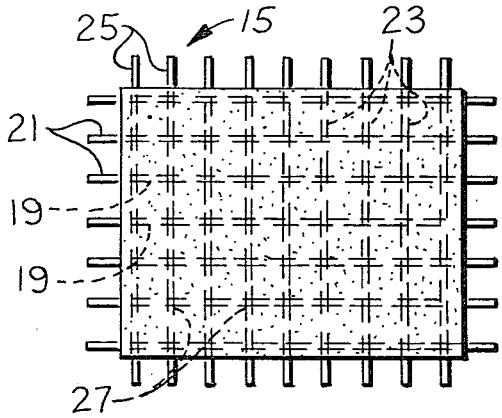
FIG. 1*b* illustrates a preferred type of fiber reinforced insulation employed in the system of FIG. 1.

Positioned around the vertical wall of tank 18 is a loose bulk insulation material 26 such as the material marketed as Perlite. Positioned around and supporting the loose insulation material is a load bearing fiber reinforced foam insulation layer 28. Such fiber reinforcement foam insulation layer is preferably three-dimensional glass fiber reinforced polyurethane foam. Such fiber reinforced insulation material comprises blocks or panels of closed cell polyurethane foam having layers of glass fibers, each layer of fibers extending in both a horizontal and transverse direction, the X and Y reinforcement fibers, and layers of fibers extending in a vertical direction, the Z reinforcement fibers. FIG. 1*b* illustrates this type of material comprising blocks 15 of closed cell polyurethane foam having layers of glass fibers 19 embedded in the foam and having exposed fiber ends 21 to facilitate bonding of the reinforced polyurethane blocks 15 to a structural member such as a tank wall. The polyurethane block 15 has other glass fibers 23 extending vertically, with exposed fiber ends 25 to facilitate bonding of the individual blocks to each other, and for bonding to the steel liner 34. This type of reinforcement is known as X-Y-Z reinforcement, the X fibers being longitudinal fibers, the Y fibers transverse fibers and the Z fibers vertical fibers, e.g., as shown in U.S. Pat. No. 3,222,868, incorporated herein by reference, and the resulting reinforced foam is also known as "3D foam". Preferably, planks of such 3D polyurethane foam are bonded together by a suitable adhesive, preferably a polyurethane adhesive, to form the outer insulation layers.

Fiber reinforced or 3D load bearing foam insulation is also positioned at 30 on the concrete floor slab 12 to support the inner tank 18 by means of the support member 22 which rests on the 3D foam insulation layer 30. The space 32 between the bottom of the tank 18 and 3D foam insulation layer 30 can also be filled with 3D foam insulation or other load bearing insulation material, to support the hydrostatic loads generated by the tank contents.

An essentially cylindrical steel liner 34 is positioned around the tank 18 between the 3D foam insulation layer 28 and the vertical concrete wall 14, and has a bottom portion 35 positioned between the 3D foam insulation layer 30 below the bottom of tank 18 and the concrete floor slab 12. Such liner prevents water which may pass through the porous concrete wall 14, from entering the insulation system between the liner 34 and the inner tank 18.

Figure 2:
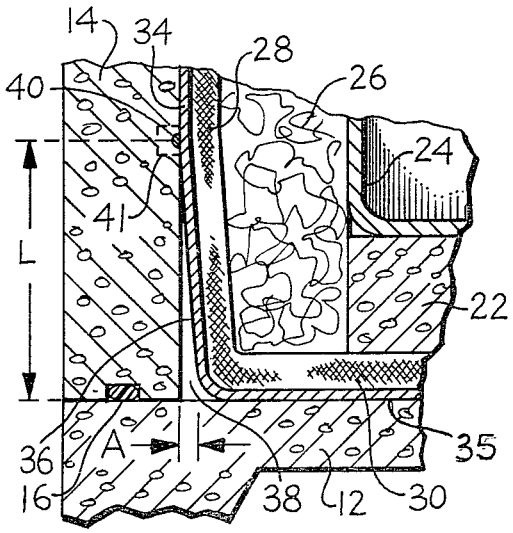
FIG. 2 is a detailed sectional view of the flexible corner section of FIG. 1.

Referring also to FIG. 2 for greater clarity, it will be seen that the lower vertical portion of the steel liner 34 is inclined downwardly at an angle to the vertical as indicated at 36. This forms a gap 38 to allow space for radial inward motion of the outer concrete wall 14 with respect to the floor slab 12. The liner 34 is attached to the outer concrete wall by suitable means such as by welding at point 40 to a plate 41 embedded in the concrete wall, the point 40 being a distance L above the floor slab 12. The maximum width of the gap 38, as indicated at A, is chosen equal to the maximum possible wall inward motion during the most severe service conditions. The distance L for attachment of the liner 34 to the vertical slab 14 is chosen based on the flexing stresses in the liner and insulation during maximum outer tank operating deflections. If gap A is too small, some buckling could occur, and if the gap is too large, the stresses in components such as the steel liner 34 could rise to a dangerously high value. However, these conditions can be alleviated by using as the liner 34 a high nickel steel, e.g. a 9% nickel steel in which some permissible yielding may occur. It will be noted that the 3D foam insulation at 28 and 30 can be bonded as by adhesive bonding, e.g. by polyurethane adhesive, to the steel liner 34, for support thereon.

During service conditions, if the concrete wall 14 moves laterally inward, due to the gap A, the steel liner 34 and the insulation layer 28 supported on the liner will flex to maintain a liquid seal at the corner.

The concrete lined container shown in FIG. 1 can be buried in the ground and supported on a plurality of piles 43 positioned around the outer periphery of the concrete base 12. A dome shaped roof 42 constructed of concrete or steel is supported on the upper end of the concrete wall 14 of the tank structure, and supported on cables 44 suspended from the roof is a flat structure 46 covering the top of the inner tank 18. The structure at 46 can comprise an open mesh material such as a screen, (not shown) filled with an insulation material such as fiberglass batting, as indicated at 48.

As previously noted, the entire container structure 10 including the inner tank 18 can be buried in the ground with a berm 50 around the tank structure extending to the upper end of the vertical concrete wall 14 of the container, leaving only the dome shaped roof 42 exposed.

Figure 3:
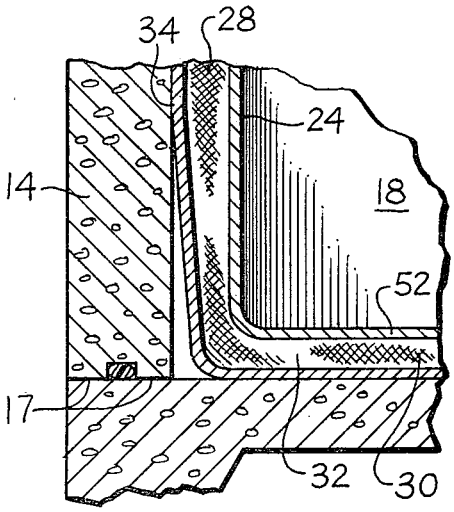
FIG. 3 is a modification of the flexible corner section shown in FIG. 2.

Referring to FIG. 3, there is shown a modification of the flexible corner seal construction of the invention, wherein no loose or bulk insulation as at 26 in FIGS. 1 and 2, is employed around the liner 24 of the inner tank, and wherein the vertical portion of the inner liner 24 of tank 18 is positioned directly in contact with the load bearing 3D foam insulation 28. Also, in FIG. 3 the tank supports 22 of FIG. 1 are omitted, and the tank 18 and inner liner 24 at the bottom of the tank, as indicated at 52, are also supported directly on the load bearing 3D insulation material 32 below the bottom of tank 18. Thus, in FIG. 3 the 3D foam insulation layers 28 and 30 are positioned directly in contact with the inner liner 24 of tank 18, and the outer steel liner 34.

Although the corner seal of the invention is particularly applicable for sealing a moveable outer concrete wall of an LNG storage tank with respect to its concrete floor, such corner seal is also useful in any cryogenic application where a seal is required across a moving corner.

According to a modification, if desired, a plywood sheet (not shown) can be positioned along the inside surfaces of the load bearing 3D foam insulation layers 28 and 30 for further support and protection during the tank construction phase.

Accordingly, the invention provides a cryogenic liquid corner seal of simple construction, between moving concrete structural elements, provides complete thermal protection of the 3D foam insulation to the outer concrete tank in conjunction with such seal, and combines such sealing and thermal protection properties with the load bearing properties of 3D foam insulation to provide structural support for the inner tank.

While I have described particular embodiments of my invention for purposes of illustration, it is understood that other modifications and variations will occur to those skilled in the art, and the invention accordingly is not to be taken as limited except by the scope of the appended claims.

What is claimed is:

1. In a cryogenic container comprising a concrete floor slab, a concrete wall moveably supported on said floor slab, insulation positioned within the container adjacent the floor slab and the concrete wall; and a metal liner positioned around the inner surface of said container adjacent the inner surface of the floor slab and said concrete wall and supporting said insulation, and forming an inner seal around the container; the improvement which comprises providing said liner with an inclined lower portion at a corner above said floor slab, and means connecting said inclined lower portion at its upper end to said concrete wall at a predetermined distance above said floor slab, and forming a gap between said liner and said concrete wall at said corner, and permitting inward lateral motion of said concrete wall with respect to said floor slab at said corner, while permitting said metal liner and said insulation supported by said liner to flex and maintain a seal at said corner.

2. The cryogenic container of claim 1, said container comprising an inner tank for cryogenic liquid, said tank having an inner liner, said insulation being disposed between said inner liner of said inner tank and said metal liner.

3. The cryogenic container as defined in claim 2, said insulation comprising load bearing 3D foam insulation.

4. The container as defined in claim 3, including loose bulk insulation between the wall of said inner tank and said load bearing foam insulation.

5. The container as defined in claim 2, said inner tank liner comprised of Invar.

6. The container as defined in claim 3, said load bearing 3D foam insulation being bonded to the inner surface of said metal liner, and including loose bulk insulation between said 3D foam insulation and the outer surface of said inner liner.

7. The container as defined in claim 3, said metal liner and said insulation being disposed around the sides and bottom of the interior of said concrete container.

8. The container as defined in claim 7, including means for supporting said inner liquid tank on said load bearing insulation at the bottom of said concrete container, and additional insulation between the bottom of said inner tank and said load bearing insulation on the bottom of said concrete tank.

9. The container as defined in claim 2, including a top construction over said inner tank, and insulation supported on said top construction.

10. A cryogenic container comprising a horizontal concrete floor slab, a vertical concrete wall, means supporting said concrete wall at the lower end thereof for lateral movement with respect to said concrete floor slab, a steel liner positioned around the inner surface of said container adjacent the inner surfaces of the floor slab and the concrete vertical wall, fiber reinforced foam insulation bonded to the inner surface of said steel liner adjacent the vertical and horizontal portions thereof, an inner tank positioned within said container, means supporting said inner tank in spaced position above the floor slab and above said foam insulation adjacent said steel liner, and additional insulation material between said foam insulation and the outer wall of said inner tank, said steel liner having a downwardly inclined lower portion at a corner above said floor slab, said inclined lower portion being connected to said vertical concrete wall at a predetermined distance above said floor slab, and forming a gap between said inclined portion of said liner and said concrete wall at said corner, thereby permitting inner lateral motion of said concrete wall with respect to said floor slab at said corner, while permitting said steel liner and the insulation bonded thereto to flex and maintain a seal at said corner.

11. The container as defined in claim 10, said wall of said inner tank being a high nickel steel liner.

12. The cryogenic container as defined in claim 10, including fiber reinforced foam insulation in the space between the bottom of said inner tank and the fiber reinforced foam insulation layer adjacent said metal liner.

13. The container as defined in claim 10, including a dome shaped roof supported on the upper ends of the vertical concrete wall, a top construction over said inner tank, insulation supported on said top construction, and piles depending from said concrete slab for supporting said container in the ground.

14. The container as defined in claim 10, said container having a cylindrical shape, and said steel liner being essentially cylindrical and having a vertical wall portion and a horizontal bottom portion, said inclined lower portion of said steel liner interconnecting said vertical wall portion and horizontal bottom portions thereof.

15. The container as defined in claim 10, said fiber reinforced foam insulation being X, Y and Z fiber reinforced polyurethane foam insulation.

* * * * *